United States Patent [19]

Matsuzaki

[11] Patent Number: 4,619,175

[45] Date of Patent: Oct. 28, 1986

[54] INPUT DEVICE FOR AN ELECTRONIC MUSICAL INSTRUMENT

[75] Inventor: Akio Matsuzaki, Tokorozawa, Japan

[73] Assignee: Casio Computer Co., Ltd., Tokyo, Japan

[21] Appl. No.: 560,155

[22] Filed: Dec. 12, 1983

[30] Foreign Application Priority Data

| | | | |
|---|---|---|---|
| Dec. 21, 1982 | [JP] | Japan | 57-192111[U] |
| Dec. 30, 1982 | [JP] | Japan | 57-196779[U] |
| Dec. 30, 1982 | [JP] | Japan | 57-196782[U] |
| Feb. 10, 1983 | [JP] | Japan | 58-17415[U] |

[51] Int. Cl.[4] ..... G10H 1/00

[52] U.S. Cl. ..... 84/1.01; 84/1.14; 84/1.24; 84/DIG. 7; 84/DIG. 14; 84/377

[58] Field of Search ..... 84/1.14, 1.01, 377, 84/1.24, DIG. 7, DIG. 14

[56] References Cited

U.S. PATENT DOCUMENTS

| | | | |
|---|---|---|---|
| 4,252,045 | 2/1981 | Nagura | 84/1.14 |
| 4,385,541 | 5/1983 | Müller et al. | 84/1.14 |

FOREIGN PATENT DOCUMENTS

| | | | |
|---|---|---|---|
| 2741641 | 3/1978 | Fed. Rep. of Germany | 84/377 |
| 3120835 | 12/1982 | Fed. Rep. of Germany | 84/377 |

*Primary Examiner*—Forester W. Isen

*Attorney, Agent, or Firm*—Frishauf, Holtz, Goodman & Woodward

[57] ABSTRACT

An input device for an electronic musical instrument, has blown air apertures and suction air apertures alternately disposed on the front face of its main body. This input device also has elastic members provided within the blown air apertures and suction air apertures, in such a way as to be deformed by the force of the air caused to flow through said blown air apertures and suction air apertures. The input device also has magnets or pressure members serving as operation members, which magnets or pressure members are each displaced by an elastic member, and a plurality of musical tone input switches are driven by the displacement of the magnets or pressure members.

15 Claims, 19 Drawing Figures

INPUT DEVICE FOR AN ELECTRONIC MUSICAL INSTRUMENT

BACKGROUND OF THE INVENTION

The present invention relates to an input device for an electronic musical instrument, wherein the air blown out of or sucked into the device is used as a drive source for driving a musical tone input switch.

In recent years, various electronic musical keyboard instruments have been developed. In the conventional keyboard instrument, the foot or fingers are used as drive sources for actuating musical tone input switches. However, a considerable amount of time is generally required for an ordinary person to become skilled in the playing of such a keyboard instrument. On the other hand, more than a few persons who cannot play such a keyboard instrument are nevertheless able to play any memorized melody on a harmonica, without reading a score.

SUMMARY OF THE INVENTION

An object of the present invention is to provide an input device for an electronic musical instrument, which makes is possible for even a beginner to easily play a melody with the same feeling as if he were playing the harmonica, by using the air blown out and sucked in as a drive source to actuate musical tone input switches. The device makes it possible to produce a much wider variety of musical expressions than in the case of playing the conventional harmonica, although it is structurally simple.

According to the present invention, an input device for an electronic musical instrument is provided, which device comprises a plurality of ducts; a plurality of actuators driven by the air blown out and sucked in, which flows through the ducts; and a plurality of musical tone input switch means which are made operational by the actuators.

DETAILED DESCRIPTION OF THE PREFERRED EMBODIMENTS

Figure 1:
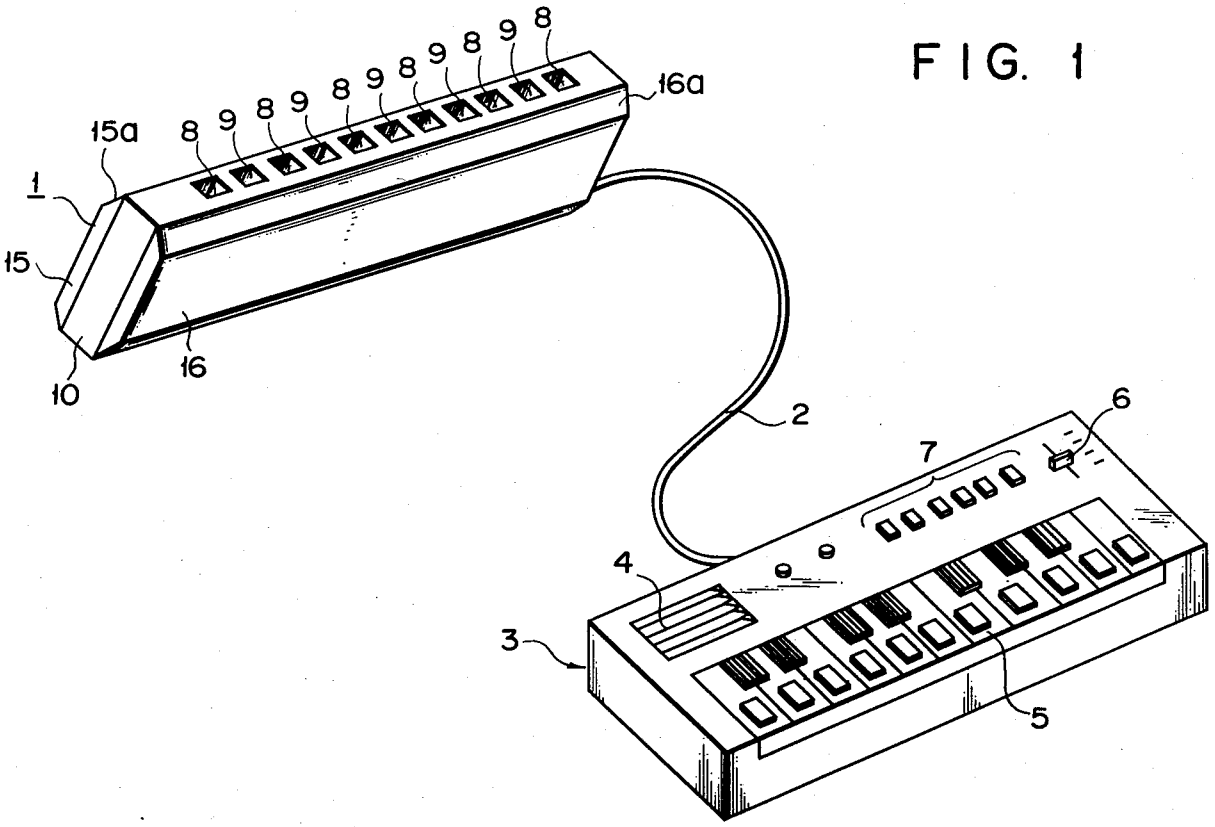
FIG. 1 is an outer appearance perspective view of the overall structure of an electronic musical instrument, according to an embodiment of the present invention.

FIG. 1 shows an embodiment of the invention, wherein an electronic harmonica is used in combination with an electronic keyboard instrument. In FIG. 1, a musical tone signal supplied from the electronic harmonica 1 is connected to a musical-tone designating input terminal of the electronic keyboard instrument 3 through a cord 2, whereby a musical tone having the pitch thus designated is generated from a loud speaker 4 of the keyboard instrument. When the electronic harmonica 1 is not used in combination, the musical keyboard instrument 3 is used as an ordinary musical keyboard instrument by operating a keyboard 5, a mode change-over switch 6 and a tone color selecting switch 7. When the electronic harmonica 1 is used in combination, the mode change-over switch 6 is switched from a hand mode to a mouth mode, i.e., to a harmonica mode, whereby an electronic-harmonica performance becomes possible, with the tone color being selected by the operation of the tone color selecting switch 8.

As in the case of an ordinary harmonica, the electronic harmonica 1 is constructed in such a way that a number of blown air apertures 8 and suction air apertures 9 are alternately disposed at the forward end of a slender main body 10 of the electronic harmonica. The blown air aperture 8 and the suction air aperture 9 are formed in such a manner as to pass through the main body 10; and the actuators provided within the apertures 8, 9 are actuated or driven by the air blown out and the air being sucked in, whereby a musical tone input switch built therein is switched on and off. Note here that covers 15 and 16 are attached onto both sides of the main body 10, respectively. Inclined surface portions 15*a* and 16*a* are formed on those portions of the covers 15 and 16 which are adjacent to the blown air apertures 8 and suction air apertures 9 of the main body 10. As a result, the mouth touch becomes more smooth when playing on the electronic harmonica 1.

Figure 2:
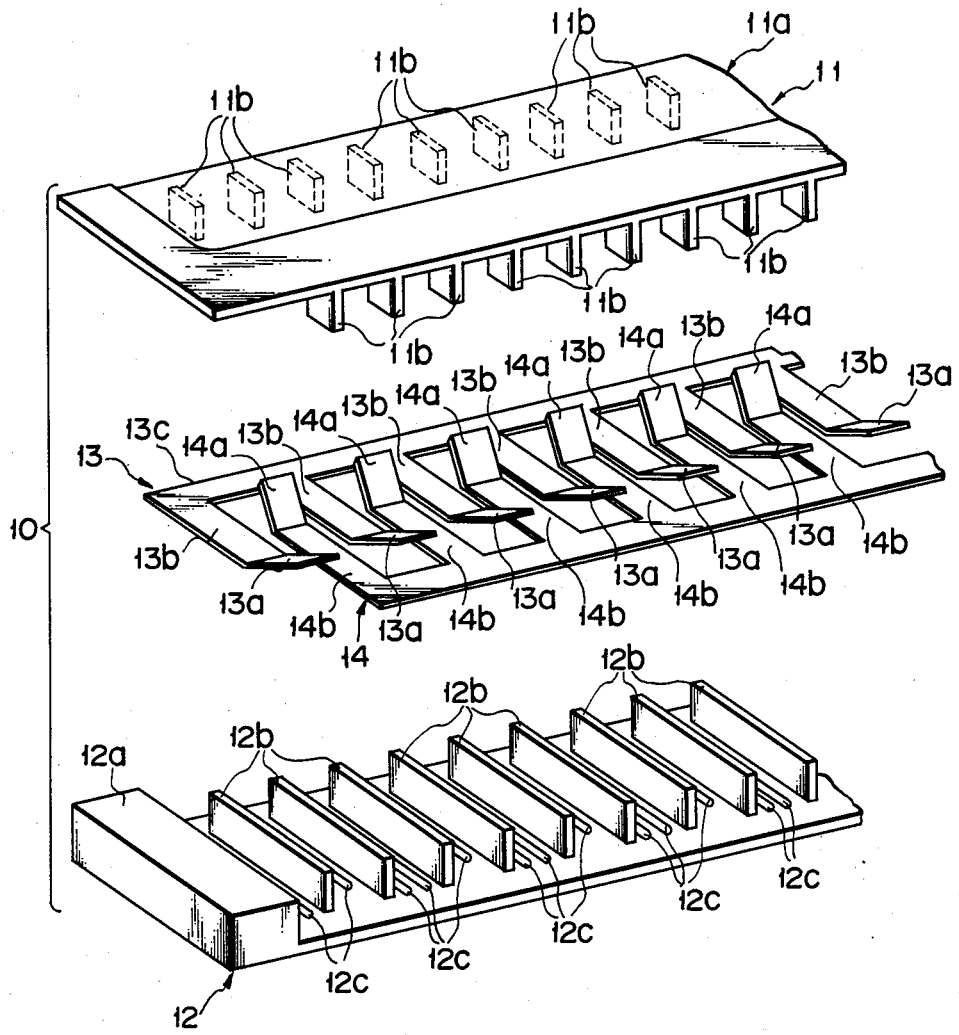
FIG. 2 is an enlarged perspective disassembled view of the embodiment shown in FIG. 1.

The structure of the main body 10 of the electronic harmonica 1 may now be described, with reference to FIG. 2. The main body 10 is comprised of an upper case 11 and a lower case 12, between which comb-like actuator plates 13, 14 are sandwiched in combination, in such a manner that both are interdigitated with each other.

The lower case 12 consists of a slender flat plate with square-bar like attachment portions 12*a* respectively formed at its ends, on the upper surface of which plate a number of partitioning wall members 12*b* alternately partitioning the blown air apertures 8 and the suction air apertures 9 are projectively formed, so that they may be arranged in parallel, in the widthwise direction. The length of each partitioning wall member 12*b* is shorter than the width of the lower case 12, which partitioning wall member 12*b*, therefore, has its ends located between both sides of the lower case 12. Two air guide grooves 12*c*, 12*c* are formed, along the direction of the partitioning wall member 12*b*, in the upper surface portion of the lower case 12 defined between two adjacent partitioning wall members 12*b*. Those of the air guide grooves 12*c* which correspond to the blown air apertures 8 are each formed from the lower right-hand side of the ilustration and are biased to that side, so that the groove may be shorter at the upper left-hand side of the illustration. On the other hand, those of the air guide grooves 12*c* which correspond to the suction air apertures 9 are each formed from the lower left-hand side of the illustration and are biased to that side, so that the groove may be shorter at the right and left-hand sides of the illustration.

The upper case 11 is in the shape of a flat plate having the same size as that of the flat plate constituting the lower case 12; and, on the upper surface of the upper case 11, a recessed portion 11a is formed, in which portion 11a a print plate 18 (to be described later) is received. On the underside of the upper case 11, pairs of partitioning pieces 11b are so formed that each pair is continuous to the ends of each corresponding partitioning wall member 12*b* of the lower case 12. Accordingly, the main body 10 of the electronic harmonica is constructed in such a way that the upper cae 11 and lower case 12 are combined, permitting the paired partitioning pieces 11*b* of the upper case 11 to continue on the ends of the corresponding partitioning wall member 12*b* of the lower case 12, whereby the blown air apertures 8 and the suction air apertures 9 are alternately arranged. Within the blown air apertures 8, elastic members serving as the actuator plate 13 are disposed and, within the suction air apertures 9, elastic members serving as the actuator plate 14 are disposed. As shown in FIG. 2, the actuator plate 13 has elastic tongue pieces each consisting of an inclined portion 13*a* and a bending portion 13*b*, and is formed by being punched out of a single thin film-like elastic sheet made of, e.g., polyester, into the form of a comb having teeth. All of the end portions of the tongue pieces are integrally connected together by means of a connecting portion 13*c*. Further, the actuator plate 14 is also similarly formed by being punched out of a single elastic sheet into the form of a toothed comb and all of the tonque pieces thereof have their one-side ends connected together by means of a connecting portion 14*c*. When the main body 10 of the electronic harmonica is assembled, the tongue pieces of the actuator plates 13 and 14 are alternately disposed in advance, in a state wherein those tonque pieces are arranged as shown in FIG. 2, between the partitioning wall members 12*b* of the lower case 12. The connecting portion 13*c* of the actuator plate 13 is pasted onto the upper surface, at the upper left-hand side of the lower case 12, by means of, e.g., an adhesive agent; and, at the same time, the connecting portion 14*c* of the other actuator plate 14 is similarly pasted onto the upper surface, at the lower right-hand side of the lower case 12. Thereafter, the upper case 11 is combined with the lower case 12, in such a manner as to permit those connecting portions of the actuator plates 13, 14 to be pressed by the partitioning pieces 11b of the upper case 11. Thus, the actuator plates 13, 14 are incorporated into the main body 10 of the harmonica.

Figure 3B:
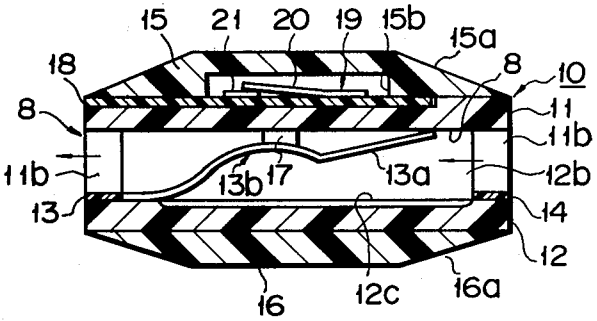
FIGS. 3A and 3B are enalrged sectional views of a one-duct portion of FIG. 1, which show the structure thereof before and after the actuators are driven by the air breathed in and out, respectively.
Figure 3A:
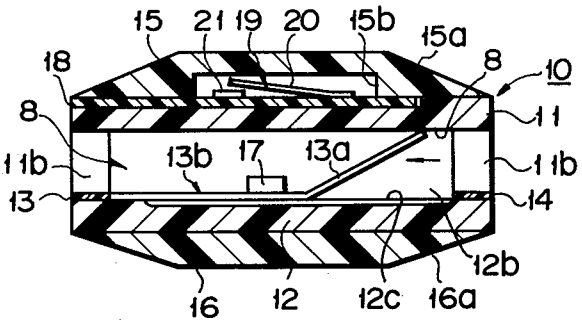

Of the actuator plates 13, 14 disposed within the blown air apertures 8 and suction air apertures 9 in the above-mentioned manner, the actuator plate 13 disposed within the blown air aperture 8 is so arranged that, as shown in FIG. 3A, the rear end of the bending portion 13*b*, i.e., the side thereof at which the air flows out (left side of the illustration), is adhered and fixed. The other end of the bending portion 13*b*, i.e., the side thereof at which the air flows in, is extended on the inner bottom surface of the blown air aperture 8, and is bent upwards in an oblique manner, in such a way as to become the inclined portion 13*a*. The tip end of the inclined portion 13*a* which is thus bent is allowed to come into contact with the top surface of the blown air aperture 8, to thereby close the aperture 8. Accordingly, the actuator plate 13 serving as an actuator is such that when the blown air enters the blown air aperture 8 from the side of inflow thereof, it is guided by the inclined portion 13*a* to enter the air guide groove 12*c* of the lower case 12. As a result, the bending portion 13*b* is elastically deformed, due to the entry of the blown air, in such a manner as to be expanded as shown in FIG. 3B. A magnet 17 is attached onto a flattened portion of the bending portion 13*b* of the actuator plate 13, by means of, for example, an adhesive magnet. This magnet 17 does not hinder the bending portion 13*b* from being elastically defomed, but moves vertically within the blown air aperture 8, in accordance with the elastic deformation of the bending portion 13*b*. The above-mentioned print plate 18 is disposed on the outer upper surface of the harmonica body 10, i.e., the recessed portion 11*a* of the upper case 11. On this print plate 18, a switch sectin 19 is provided, which switch member 19 is comprised of a movable plate 20 composed of a magnetic metal. The plate 20 is attracted to the magnet 17 which lifts upward when the bending portion 13*b* is expanded upwards; and a stationary contact member 21 is brought into contact with the tip end of the movable plate 20 when the same is attracted to the magnet 17. The movable plate 20, which is in the form of a slender strip, is secured, at its right end, to the print plate 18, and has its left end portion opposed to the stationary contact member 21 at a position located above the same, so that its left end portion may be brought into contact with the stationary contact member 21. Accordingly, since the magnet 17 is disposed on the bottom of the blown air aperture 8, as shown in FIG. 3A, it is normally impossible for the movable plate 20 to be attracted by the magnet 17 in such away as to come into contact with the stationary contact member 21. On the other hand, when the blown air is forced to flow into the blown air aperture 8 and, due to this flow of the blown air, the bending portion 13*b* is elastically defomed or expanded, the magnet 17 is pushed upwards, as shown in FIG. 3*b*. The free end of the movable plate 20 is attracted to the magnet 17, coming into contact with the stationary contact member 21, whereby a contact signal is produced by the stationary contact member 21.

Just within the blown air aperture 8, the actuator portions 14*a*, 14*b* of the actuator plate 14, the magnet 17 and the switch member 19 are also provided within the sucked air aperture 9. In this case, only the actuator portions 14*a* and 14*b* of the actuator plate 14 are arranged, as shown in FIG. 2, in the order reversed from the order in which the actuator portions 13*a* and 13*b* of the actuator plate 13 are arranged within the blown air aperture 8 as shown in FIGS. 3A and 3B. In said case as well, the inclined portion 14*a* of the actuator plate 14, that is to say, the end portion thereof at the side at which the air being sucked flows into the suction air aperture 9, is bent upwards in an oblique manner at one end of the bending portion 14*b* extending on the upper bottom surface of the suction air aperture 9. A tip end of the inclined portion 14*a* thus prepared is allowed to contact with the top surface of the suction air aperture 9, thereby to close the interior of the suction air aperture 9. It should be noted here that a recessed portion 15*b* for receiving the switch section 19 therein is formed on the underside of the harmonica.

Figure 4:
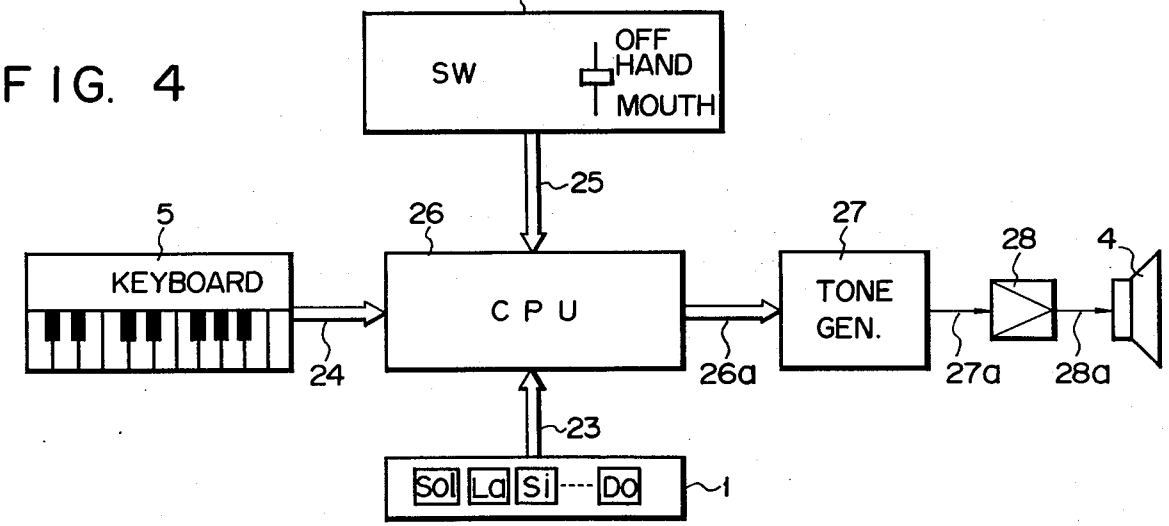
FIG. 4 is a block circuit diagram showing the circuit construction of the electronic musical instrument of FIG. 1.

The circuit construction of the electronic harmonica 1 and electronic musical keyboard instrument 3 is as shown in FIG. 4. Thus, the circuit shown in FIG. 4 comprises: the main harmonica body 10 for producing, as a tone designation signal 23, the contact signal output from the stationary contact member 21 of the switch section 19; a keyboard section 5 for permitting the designation of a tone by a finger touch operation, to produce a tone data signal 24; a mode change-over section 6 for changing over the mode, to produce a mode signal 25; a Central Processing Unit 26 to which the signals 23, 24, 25 are input and from which a data signal 26*a* is output; a musical tone generating section 27 for generating musical tones in accordance with the data signal 26*a* from the Central Processing Unit (hereinafter referred to as a, "CPU") 26; an amplifier section 28 for amplifying the musical tone signal 27*a* output from the musical tone generating section 27; and a loud speaker section 4 for generating musical sounds in accordance with the signal 28*a* output from the amplifier section 28.

The operation and function of the electronic musical instrument having the foregoing construction may be described as follows. First, where a melody is performed on the electronic harmonica 1, the mode change-over section 6 is set, in advance, to the mouth or harmonica mode, and the mode signal 25 is input to the CPU 26 beforehand. In this state, the mouth is applied to a forward end portion of the harmonica body 10 and the breathing in and out operation is carried out with respect to desired ones of the blown air apertures 8 and suction air apertures 9 alternately arranged in the sequence of a scale. Assume now that, at this time, the blown air is forced into the blown air apertures 8 kept in the state shown in FIG. 3A. Then, the air is allowed to flow in the direction indicated by the arrow and this flow of air is guided by the inclined portion 13*a* to enter the space defined between the bending portion 13*b* and the air guiding groove 12*c*. As a result, the bonding portion 13*b* is elastically deformed in such a manner as to be expanded, thereby pushing the magnet 17 upwards. Then, the movable plate 20 on the print plate 18 has its free end portion attracted to the magnet 17 thus pushed upwards and brought into contact with the stationary contact member 21. When the movable plate 20 is brought into contact with the stationary contact member 21, the contact signal output from the stationary contact member 21 is supplied to the CPU 26 (from the harmonica body 10) as the tone designation signal 23. Then, the data signal 26*a* is output from the CPU 26 to the musical tone generating section 27; and the musical tone signal 27*a* prepared therein is amplified by the amplifier section 28 and is then input into the loud speaker section 4 as signal 28*a*. Thus, a musical sound which has a pitch corresponding to the blown air aperture 8 is generated from the loud speaker section 4.

On the other hand, where the air is sucked in through the suction air aperture 9, an air flow occurs due to the suction operation. Accordingly, the inclined portion 14*a* of the actuator plate 14 is defomed in such a manner as to be expanded, due to its elasticity. As a result, as in FIGS. 3A and 3B, the magnet 17 is pushed upwards, whereby the movable plate 20 corresponding to the suction air aperture 9 is attracted to the magnet 17 and is thus brought into contact with the stationary contact member 12. When, in this way, the movable plate 20 is brought into contact with the stationary contact member 12, the tone designation signal 23 corresponding to the suction air aperture 9 is output from the harmonica body 10 to the CPU 26, as in the above-mentioned case. Thus, a specified musical sound is generated from the loud speaker section 4, through the above-mentioned signal path.

According to the above-mentioned electronic musical instrument, since the breathing-in-and-out of air is used as a means for actiating the musical tone input switch, it is possible for not only a person who is able to play the harmonica, but even for a beginner, to easily input the musical tone required for a performance. In addition, since each actuator plate 13, 14 is formed as an integral unit by being punched out of a single elastic sheet into the form of a comb, the harmonica body serving as the input device for an electronic musical keyboard instrument can be formed, with high efficiency, of the two actuator plates 13 and 14. Thus, according to the above-mentioned electronic musical instrument, the number of parts or members is reduced and, in addition, the actuator plates 13, 14 may be incorporated, one at a time, into the input device. Thus, the assembly operation is simplified.

The arrangement of the above-mentioned embodiment is one in which tone generation is simultaneously effected, based on the output of the electronic harmonica 1; and tone generation based on the output of the electronic musical keyboard instrument is made impossible by providing the mode switch 6. However, the present invention is not limited thereto. It is also possible to arrange the construction in such a way that the electronic harmonica 1 and the electronic musical keyboard instrument 3 may be performed on simultaneously by two operators or players, respectively; and in such a way that signals 23 and 24 are thereby simultaneously output from the harmonica 1 and the keyboard instrument 5, thereby causing the respective musical sounds to be simultaneously generated in accordance with those signals 23, 24. Therefore, if the musical tone generating section 27 is of a time-divisional polyphonic construction, it will be possible to play a melody on the harmonica and, simultaneously, to play an accompaniment on the keyboard 5, to thereby create a duet.

In the above-mentioned embodiment, the switch section 19 is comprised of the movable plate 20 and the stationary contact member 21. The present invention is not limited thereto, however. In the descriptions to follow, the same or corresponding portions as those illustrated in FIGS. 3A and 3B are denoted by like reference numerals.

Figure 5A:
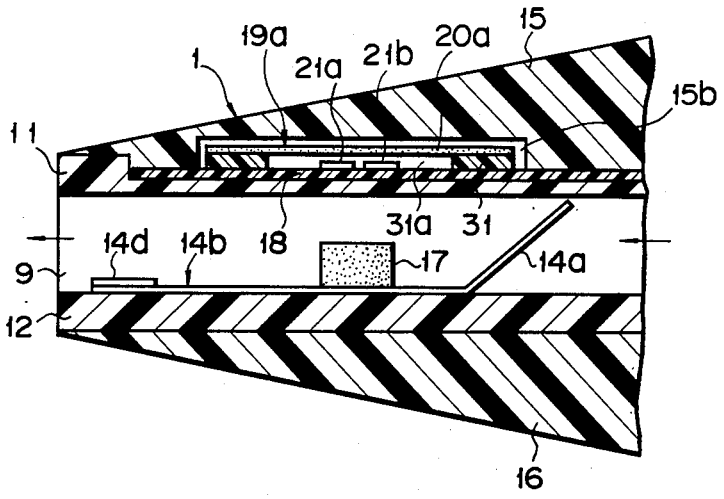
FIGS. 5A and 5B are sectional views of another embodiment of the present invention.
Figure 5B:
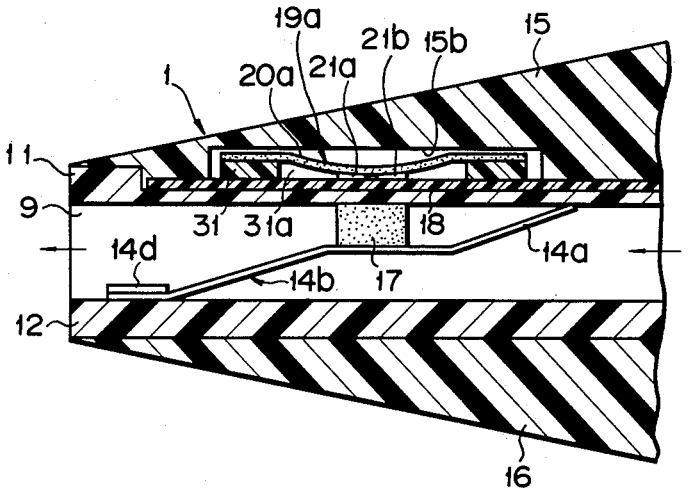

In FIGS. 5A and 5B, an actuator is used, which is comprised of the bending portion 14*b* and inclined portion 14*a* provided within the suction air aperture 9. In this case, one end of each bending portion 14*b* is independently fixed within the suction air aperture 9 by means of the attachment member 14*d*. The switch section 19*a* is comprised of paired stationary contact members 21*a*, 21*b* provided on the print plate 18 and a conductive magnetic sheet 20*a* supported by spacers 31 at a position located above the stationary contact members and spaced from the same. In this case, when air is forced to flow through the interior of the suction air aperture 9 in a direction indicated by the arrows, the bending portion 14*b* of the actuator is pushed upwards by that air and is bent as shown in FIG. 5B. The magnetic sheet 20*a* is thereby attracted by the magnet 17 toward the same, whereby conduction is caused between the stationary contact members 21*a*, 21*b* and a contact signal is produced.

Figure 6:
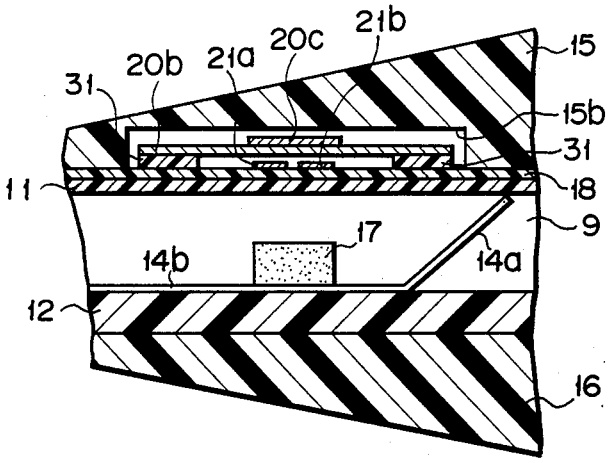
FIGS. 6 and 7 are sectional views showing the essential portions of a modification of the embodiment shown in FIGS. 5A and 5B.
Figure 7:
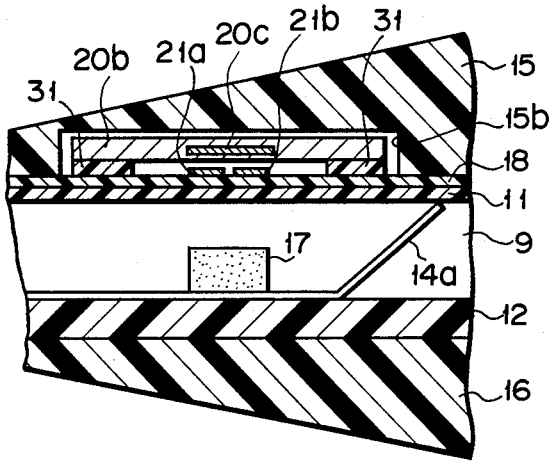

In the examples illustrated in FIGS. 3A and 3B and in FIGS. 5A and 5B, an elastic member prepared by mixing a magnetic powder with a conductive magnetic material such as a conductive rubber is used for the movable contact members 20, 20*a* attracted by the magnet 17. However, the present invention is not limited thereto. For example, the construction involved may be arranged in such a way that, as shown in FIG. 6, a magnetic plate 20*c* is pasted onto the elastic and conductive rubber sheet 20*b* at a position corresponding to the stationary contact members 21*a* and 21*b*. Alternatively, it is also posible to arrange the construction in such a way that, as shown in FIG. 7, the magnetic sheet 20*c* is buried within the conductive rubber sheet 20*b*.

Figure 8A:
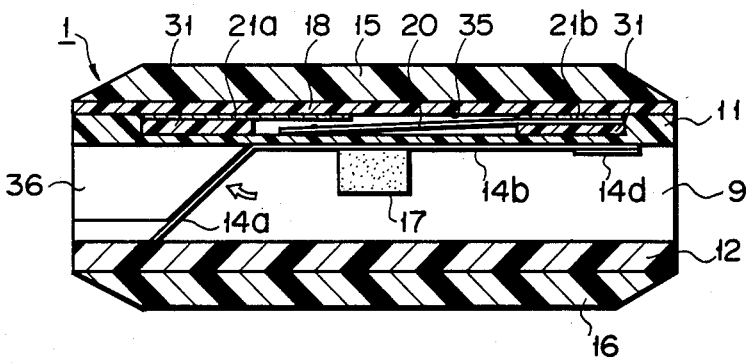
FIGS. 8A, 8B and 8C are sectional views showing a modification of the embodiment shown in FIGS. 3A and 3B.
Figure 8B:
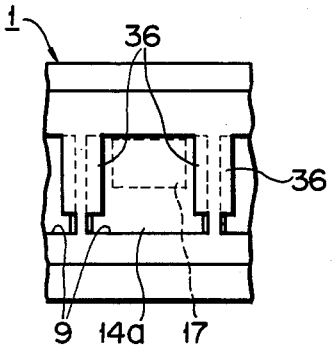
Figure 8C:
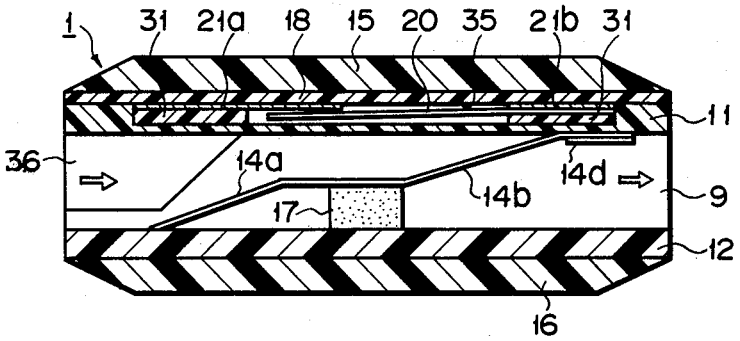

In the embodiments illustrated in FIGS. 3A and 3B and in FIGS. 5A and 5B, the tip ends of the inclined portions 13*a*, 14*a* of the actuators are only kept in contact with the inner wall surfaces of the blown air aperture 8 and suction air aperture 9. Therefore, when the sucking of air is effected through the blown air aperture 8, the air flows in a direction opposite to that shown by the arrow of FIG. 3A. As a consequence, the tip ends of the inclined portions 13*a*, 14*a* of the actuators are caused to vibrate, to thereby cause, in extreme cases, the generation of vibrational noises. FIGS. 8A to 8C show an embodiment which has been improved in this regard. A receiving portion 35 is formed on the upper surface of the upper case 11, and an opening of this receiving portion 35 is closed by the print plate 18. On the underside of the print plate 18, the stationary contact members 21*a*, 21*b* are provided, with a specified space being provided therebetween. A movable contact member 20 is provided on the underside of the stationary contact member 21*b*, in a state wherein it is retained by the spacer 31. The tip end of the movable contact member 20 is extended up to a position below the other stationary contact member 21*a*. On the top wall surface of the suction air aperture 9 corresponding to the receiving portion 35 formed therein with the switch section, one end of the bending portion 14*b* of the actuator is fixed by means of the attachment member 14*d*. On the underside of the bending portion 14*b*, the magnet 17 is mounted. Within the suction air aperture 9, a retainer member 36 having an inclined surface is provided, in such a way as to extend along an inclination of the inclined portion 14*a* provided on the other end of the bending portion 14*b*.

When, as shown in FIG. 8A, the blown air is allowed to flow within the suction air aperture 9, from right to left, the inclined portion 14*a* is pressed against the inclined surface of the retainer member 36, by the force of that air flow, as indicated by the arrow. For this reason, it is impossible for the inclined portion 14*a* to be caused to vibrate by the blowing of the air through the suction air aperture 9.

When, as shown in FIG. 8C, the suction air is caused to flow through the suction air aperture 9, from left to right, as indicated by the arrows, the bending portion 14*b* is curved downwards, whereby the magnet 17 moves away from the switch section. Thus, the movable contact member 20 formed of a conductive magnetic material is released from the attractive force of the magnet 17, returning to its original upper position by means of its own elasticity; and comes into contact with the stationary contact member 21*a*, to produce a contact signal.

Figure 9A:
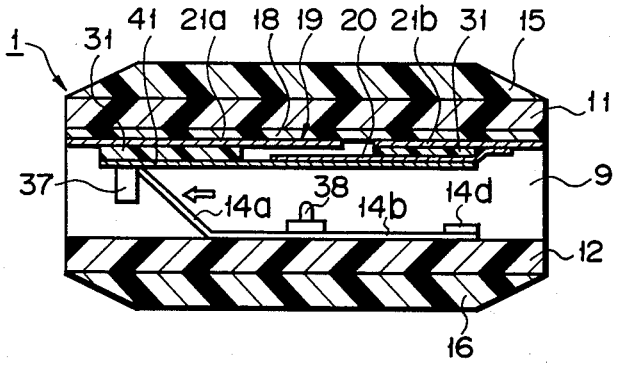
FIGS. 9A, 9B and 9C are sectional views showing the structure of still another modified embodiment of the present invention.
Figure 9B:
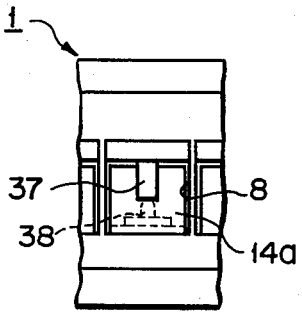
Figure 9C:
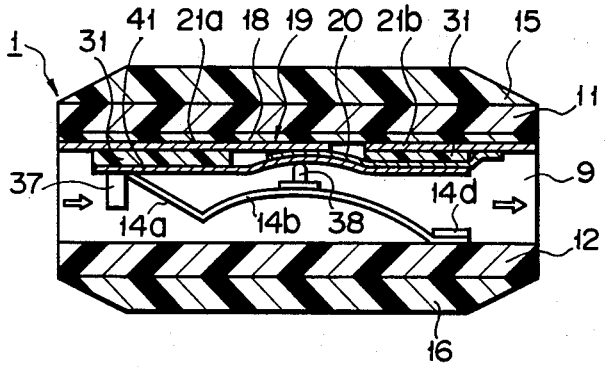

In the embodiment illustrated in FIGS. 8A to 8C, the inclined portion 14*a*, as a whole, is supported by the inclined surface portion of the retainer member 36. According to the present invention, however, it is also possible to permit only the tip end of the inclined portion 14*a* to be retained by a columnar retainer member 37 projectively provided within the suction air aperture , as shown in FIGS. 9A–9C. This retainer member 37 is attached to the spacers 31, through a soft protective layer 41. The conductive film used on the movable contact member 20 is integrally pasted onto the protective layer 41. The spacers 31 are attached to the print plate 18 through stationary contact members 21*a* and 21*b*, respectively. At that position on the bending portion 14*b* which corresponds to the conductive film 20, a rivet-shaped pressure member 38 is mounted in a state wherein it is pointed upwards, and the tip end of the bending portion 14*b* is secured to the inner bottom surface of the suction air aperture 9, by means of the attachment member 14*d*.

In this case, as well; even when the blown air is caused to flow through the suction air aperture 9 in the direction indicated by the arrow of FIG. 9A, no vibrational noise occurs, since the tip end of the inclined portion 14*a* is retained by the retainer member 37.

When, as shown by the arrows of FIG. 9C, the suction air is caused to flow through the interior of the suction air aperture 9 normally, the bending portion 14*b* is curved upwards, as shown, with the result that the pressure member 38 pushes the protective layer 41 and the movable contact member 20 upwards. Since, as a result, the movable contact member 20 is brought into contact with the stationary contact member 21*a*, both the stationary contact members 21*a* and 21*b* are connected together through the movable contact member 20, whereby a contact signal is produced. In this way, the switching-on-and-off operation of the contact members may be carried out by using, in place of the magent 17 shown in FIGS. 8A and 8B, the mechanical pressure force based on the bending action of the bending portion 14*b*.

Figure 10A:
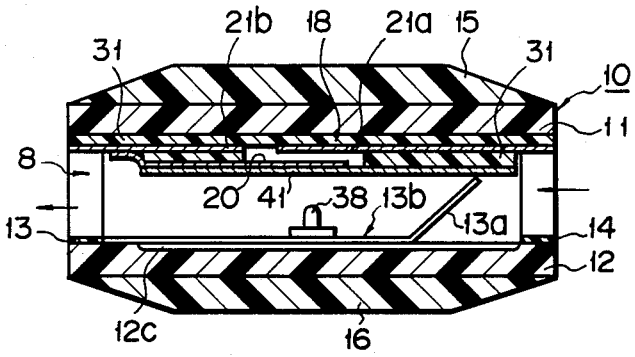
FIGS. 10A and 10B are sectional views showing a modification of the embodiment shown in FIGS. 9A to 9C.
Figure 10B:
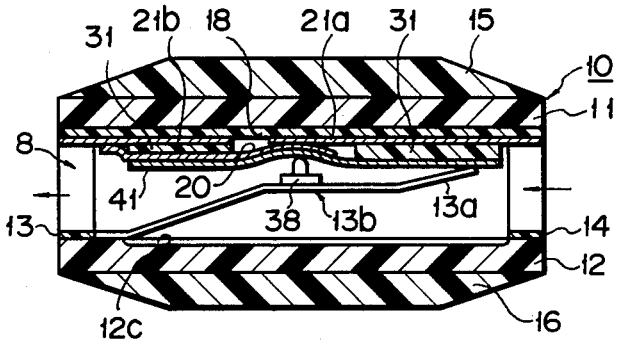

The existence of the retainer member 37 is, of course, non-essential. Therefore, the tip end of the inclined portion 13*a* may be made free, as shown in FIGS. 10A and 10B, as in the case of the embodiment shown in FIGS. 3A and 3B. In this case, as well, since the operation of the switch section is the same as in FIGS. 9A to 9C, a description thereof is omitted.

In any one of the preceding embodiments, wherein the actuation of the switch mechanism is effected by the use of the magnet 17 or by the pressure member 38, the contact opening/closing portion of the switch section is sealed off from the air passage section of the blown air aperture 8 or suction air aperture 9. Accordingly, a failure of the contact members to be interconnected, due to the entry of dust, vapor, etc., into the switch section, can hardly take place. The switch section, however, need not always be made into a sealed structure. Thus, the switch section may open into the blown air aperture 8 or suction air aperture 9.

Figure 11:
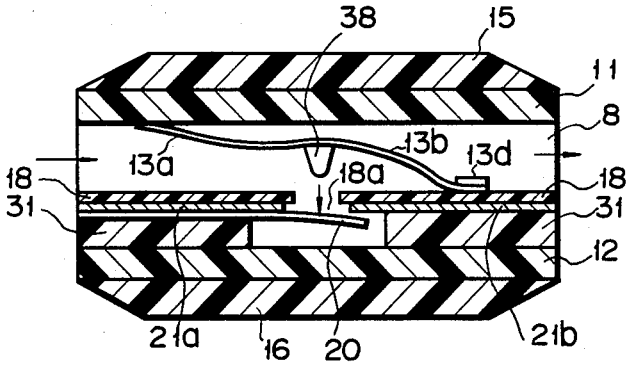
FIG. 11 shows sectional views of the structure of a further embodiment of the present invention.

FIG. 11 shows an example of such an open structure, in which the spacers 11 are provided on the side of the lower case 12 facing the blown air aperture 8; and in which the print plate 18 is attached to the spacers 31, through the stationary contact members 21*a*, 21*b*. The print plate 18 is formed with an opening 18*a*, at which the movable contact member 20 is extended up to the stationary contact member 21*b* from the stationary contact member 21*a*. On the print plate 18 one end of the bending portion of the actuator is fixed by means of the attachment member 13*d*, and, a tip end of the inclined portion 13*a* formed on the other end of the bending portion 13*b* is allowed to contact with the inner top wall surface of the blown air aperture 8. On the underside of that portion of the bending portion 13*b* which opposes the opening 18*a* of the print plate 18, the pressure member 38 is attached.

At the time of blowing the air, the air blown is forced to flow from left to right, as indicated by the illustrated arrows. FIG. 11 shows a state wherein the bending portion 13*b* is curved upwards by the force of the air flow and as a result the pressure member 38 is separated from the movable contact member 20. Thus, the movable contact member 20 is restored to its original position by its own elasticity to come into contact with the stationary contact member 21b. Thus, a contact signal is produced. If the arrangement involved were made as such, then the pressure member 38 only operates to permit releasing the movable contact member 20 from its own pressure force when the air is blown. In addition, a contact of the contact member 20 with the contact member 21*b* is made depending only upon the elasticity of the movable contact member 20. Therefore, the intensity with which the air is blown is in no way related to the state of contact of the contact member. Thus, the contact opening/closing operation becomes stable.

The embodiment shown in FIG. 1 is so constructed that the musical tone input signal formed in the electronic harmonica 1 is supplied to the musical tone signal generating section built in the musical keyboard instrument 3, thereby causing sound generation to occur from the loud speaker 4. According to the present invention, however, it is also possible to construct the electronic harmonica 1 in such a way that the it has a keyboard function, by incorporating therein a musical tone signal generating section and loud speaker.

Figure 12:
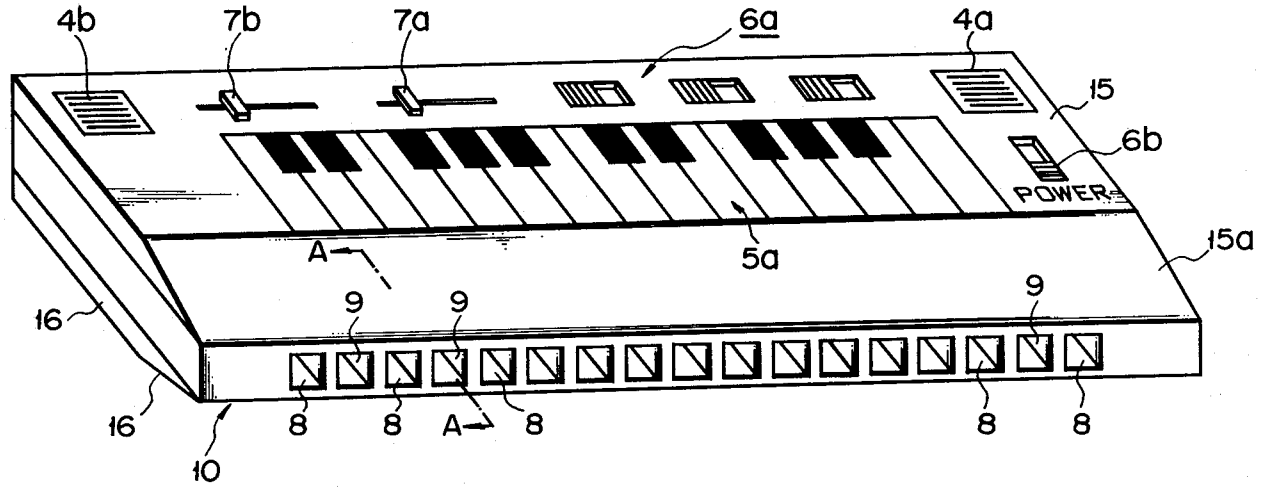
FIG. 12 is a perspective view showing the outer appearance of a further, overall embodiment of the present invention.

FIG. 12 shows an example of such an electronic harmonica 1. In this example, a keyboard 5a having touch keys corresponding to a plurality of white and black keys is provided on the upper cover 15. A mode switch section 6a for changing over to the keyboard mode, mouth or harmonica mode, bimodal mode, etc.; a power switch section 6*a;* a tone color switch section 7*a;* a volume section 7*b;* etc., are also provided on the upper cover 15. Also shown are loud speakers 4*a*, 4*b*.

Since the circuit construction shown in FIG. 12 is the same as that of FIG. 4, any further description thereof will be omitted here. It should be noted here that it is possible to play the electronic harmonica in harmony with an automatic accompaniment, by changing over the mode switch section 6*a* to the bimodal mode, if the harmonica is provided with, e.g., the function of performing such an automatic accompaniment in place of performing, e.g., an accompaniment by means of the keyboard 5*a*.

What is claimed is:

1. An input device for an electronic musical instrument, comprising:

a main body having a plurality of ducts, a plurality of actuators arranged to be driven by air sucked into and blown out of said plurality of ducts, and caused to flow through said ducts; and a plurality of musical tone input switch means associated with said ducts, each of said switch means including a conductive movable member arranged to move according to the actuation of each of said plurality of actuators by the air flowing through said ducts, an a stationary contact member arranged to produce a contact signal upon contact with said conductive movable member.

2. An input device according to claim 1, wherein each of said actuators includes an elastic member having one end secured within said duct, and the other end attached in such a way as to extend obliquely through the interior of said duct and close the same; and an operation member which is provided on said elastic member and moved in accordance with the movement of said elastic member when elastically deformed by the air which flows through said ducts.

3. An input device according to claim 2, wherein said operation member is a pressure member having a protrusion.

4. An input device according to claim 3, wherein said musical tone input switch means are each comprised of: a protective layer which, when said pressure member is displaced, is pressed and deformed by said protrusion of said pressure member; a conductive film integrally pasted onto said protective layer; and a stationary contact member which, when said conductive film is displaced, is contacted by said conductive film.

5. An input device according to claim 2, including a retaining member fixed in said duct for retaining said other end of said elastic member and for hindering vibration of said elastic member in response to the flow of air through said duct.

6. An input device according to claim 5, wherein said other end of said elastic member is provided with an inclined portion; and said retainer member has an inclined surface arranged to face and extend along the inclination of said inclined portion.

7. An input device for an electronic musical instrument, comprising:

a main body having a plurality of ducts;

a plurality of actuators, each of which comprises an elastic member having one end secured within a corresponding one of said ducts and the other end arranged to extend obliquely through the interior of the duct, and a permanent magnet provided on said elastic member for movement in accordance with the movement of said elastic member when elastically deformed by the air which flows through said duct, and a plurality of musical tone input switch means associated with said ducts and arranged to be driven by said plurality of actuators.

8. An input device according to claim 7, wherein each of said musical tone input switch means comprises a conductive movable member arranged to be subjected to a displacement force produced by the magnetic field of said permanent magnet on said elastic member, and a stationary contact member arranged to contact said conductive movable member when displaced by said magnetic field.

9. An input device according to claim 7, wherein said other end of said elastic member is retained within said duct by a retainer member, whereby vibration of said elastic member is hindered.

10. An input device according to claim 9, wherein said other end of said elastic member is provided with an inclined portion; and said retainer member has an inclined surface arranged to face and extend along the inclination of said inclined portion.

11. An input device according to claim 8, wherein said conductive movable member is formed of a conductive rubber mixed with a magnetic powder.

12. An input device according to claim 8, wherein said conductive movable member is a conductive rubber sheet with a magentic film pasted thereon.

13. An input device according to claim 8, wherein said conductive movable member is a conductive rubber sheet having a magnetic member buried therein.

14. An input device according to claim 8, wherein said stationary contact member includes first and second stationary contact members which are so provided as to allow a space to exist therebetween, said first and second stationary contact members being connected when said conductive movable member is displaced and brought into contact therewith.

15. An input device for an electronic musical instrument, comprising: a main body having a plurality of ducts and an air blowing/sucking portion in which the respective openings of said ducts are arranged in a row; elastic members provided within said ducts, each of which has a bending portion deformed by the force of the air blown out or sucked in, with each of said bending portions being integrally formed by a connecting portion; operation members, each of which is provided on a corresponding one of said elastic members, being displaced when said elastic member is defomed by the force of the air blown out or sucked in; and a plurality of musical tone input switch means, each of which is driven by a corresponding one of said operation members when the same is displaced.

* * * * *